US006592362B2

(12) United States Patent
Fisher

(10) Patent No.: US 6,592,362 B2
(45) Date of Patent: Jul. 15, 2003

(54) UTILITY LIGHTER

(75) Inventor: Gary Fisher, Kowloon Tong (HK)

(73) Assignee: Oneworld Enterprises, Ltd., Kowloon Bay (HK)

( * ) Notice: Subject to any disclaimer, the term of this patent is extended or adjusted under 35 U.S.C. 154(b) by 0 days.

(21) Appl. No.: 09/875,367

(22) Filed: Jun. 5, 2001

(65) Prior Publication Data

US 2002/0182554 A1 Dec. 5, 2002

(51) Int. Cl.[7] ..... F23Q 2/34; F23Q 2/16

(52) U.S. Cl. ..... 431/152; 431/153; 431/129; 431/253; 431/255

(58) Field of Search ..... 431/253, 255, 431/153, 277, 129, 130, 131, 132, 133, 134, 135, 136, 137, 138, 139, 140, 141, 142, 143, 144, 145, 146, 147, 148, 149, 150, 151, 152; 131/178, 243

(56) References Cited

U.S. PATENT DOCUMENTS

| | | | | | |
|---|---|---|---|---|---|
| 2,164,178 | A | * | 6/1939 | Maltner | 348/495 |
| 2,479,827 | A | * | 8/1949 | Gans | 292/121 |
| 2,626,517 | A | * | 1/1953 | Ward | 431/131 |
| 2,732,699 | A | * | 1/1956 | Ward | 431/131 |
| 2,764,883 | A | * | 10/1956 | Frankel | 431/140 |
| 5,653,525 | A | * | 8/1997 | Park | 362/119 |
| 5,788,476 | A | | 8/1998 | Sher | 431/153 |
| 6,129,544 | A | | 10/2000 | Chen | 431/153 |
| 6,135,761 | A | | 10/2000 | Chen | 431/132 |

* cited by examiner

*Primary Examiner*—Carl D. Price
(74) *Attorney, Agent, or Firm*—Darby & Darby

(57) ABSTRACT

A two-stage safety arrangement for a cigarette lighter of the piezoelectric type having a case that houses a flammable liquid container, gas release mechanism, and piezoelectric ignition element. The safety arrangement includes an ignition cover that covers the gas release mechanism, a striking lever, and a release button. To operate the lighter, a user must first depress the release button and use an upward movement to release the ignition cover and reveal the gas release mechanism. Next, the user must simultaneously depress the release button and push the striking lever rotatably downwards and away from the gas release mechanism in order to actuate the piezoelectric ignition element. Use of both hands to depress the release button and pry back the striking lever from above, near the gas release mechanism, is further prevented by providing a raised safety ridge to prevent a user from gripping the edge of the striking lever near the outlet of the gas release mechanism. The safety arrangement can be combined with a utility tool, e.g., a knife, screwdriver, nail file, etc. disposed between two lateral plates, wherein the body of the lighter serves as one lateral plate, and with the two inner faces substantially flat and parallel.

7 Claims, 6 Drawing Sheets

UTILITY LIGHTER

FIELD OF THE INVENTION

The invention relates to a piezoelectric lighter and tool combination and, more particularly, to a two-stage safety arrangement to reduce the possibility of accidental ignition, or ignition by a child.

BACKGROUND OF THE INVENTION

Conventional piezoelectric cigarette lighters are generally, inexpensive, convenient to use and easy to operate. As such, each year, many children, as well as adults, are injured by the accidental ignition of cigarette lighters. In light of the terrible consequences associated with severe burning, and the structural damage caused to real and personal property, many nations, including the United States, have developed laws to prevent the commercial marketing and sale of cigarette lighters which fail to provide adequate preventive means for actuating the piezoelectric ignition mechanism contained in these lighters.

It is a direct result of children playing with disposable cigarette lighters, as well as the accidental ignition of these lighters by adults, that house and motor vehicle fires have started, resulting in burn injuries and often death. Accordingly, under United States law, disposable, novelty and certain refillable lighters cannot be sold unless they meet certain performance requirements and function to impede accidental ignition, as well as operation of the lighter by small children. In fact, safety features for disposable lighters are so essential that under United States law, manufacturers are prohibited from supplying devices designed or intended to disable, hinder, remove or otherwise render ineffective, a child resistant mechanism or any other safety feature, of a cigarette lighter.

With the rising usage of piezoelectric cigarette lighters, it has become increasingly important to provide economical safety mechanisms for adequately protecting those people in possession, as well as those in the vicinity, of piezoelectric cigarette lighters. Piezoelectric cigarette lighters are typically provided with a flammable liquid container and a release mechanism on the upper side of the gas container, and a piezoelectric ignition element easily controllable by depressing a button, or similar structural equivalent. The conventional safety-related modifications to piezoelectric cigarette lighters typically provide an arrangement in which a modified safety implementation must be actuated before activation of the piezoelectric ignition element can be accomplished.

There is a need in the art for a piezoelectric cigarette lighter safety arrangement in combination with one or more utility tools, e.g., a knife, screwdriver, nail file, etc. The convenience associated with carrying a pocket knife manufactured to include devices such as clocks, key rings, thermometers, magnifying glasses, and the like, in combination with a piezoelectric cigarette lighter cannot be understated. A combination device of this sort will certainly prove to be very handy and will undoubtedly contribute toward the overall attractiveness of cigarette lighters, as well as pocket knives to consumers.

Accordingly, while government regulations require child-resistant measures to be implemented on all cigarette lighters, including those of the piezoelectric type, there still exists a need in the art for an economically effective device, requiring minimal structural modification from existing products, which acts to inhibit the ignition of a piezoelectric cigarette lighter by both children and adults.

SUMMARY OF THE INVENTION

The present invention is directed to a piezoelectric cigarette lighter that has a flammable liquid container, gas release mechanism, and piezoelectric ignition element. The lighter includes a safety arrangement formed by an ignition cover, a striking lever, and a release button, which interact with each other.

In use, an individual wishing to ignite the lighter must first depress the release button to release a latch so that the user can flip open the ignition cover with an upward movement of the thumb and reveal the gas release mechanism. Next, the user must continue to depress the release button while rotating the striking lever downwards and away from the gas release mechanism to actuate the piezoelectric ignition element and to begin the flow of flammable gas from the flammable liquid container. The two stage process of having to first depress the release button and flip open the ignition cover and then keep the release button depressed while the striking lever is rotated is relatively complex and is difficult to perform accidentally. Additionally, children are not able to easily perform the process.

To further prevent people otherwise incapable of performing these relatively complicated motions from attempting to use multiple fingers to depress the release button while moving the striking lever rotatably outwards from above, a raised safety ridge, near the gas release mechanism, may be provided to eliminate any grippable edge of the striking lever near the flame.

In an embodiment of the invention, the safety arrangement is combined with a utility tool combination, e.g., a knife, screwdriver, nail file, etc., disposed between two lateral plates, that are substantially flat and parallel, with the body of the lighter serving as one lateral plate, and together the two lateral plates serve as the handle for the utility/lighter combination. Between the two lateral sides diverse implements can be disposed, which can be pulled out individually by pivoting or sliding in a plane parallel to the inner faces of the lateral sides.

OBJECTS OF THE INVENTION

Accordingly, it is an object of the present invention to provide a two-stage safety arrangement for a lighter of the piezoelectric type.

An additional object is to provide the above-mentioned lighter with a two-stage safety arrangement in combination with a diverse selection of implements, e.g., a knife, screwdriver, nail file, etc.

A further object is to provide a lighter in which the area around the gas release mechanism has a raised safety ridge to prevent an individual from gripping the edge of the striking lever near the flame and possibly igniting the lighter with a portion of his hand or fingers near the gas release mechanism.

BRIEF DESCRIPTION OF THE DRAWINGS

The foregoing Summary of the Invention and Objects of the Invention, as well as the following Detailed Description of the Invention, will be better understood when read in conjunction with the appended drawings. For the purpose of illustrating the invention, there is shown in the drawings an embodiment, it being understood, however, that the invention is not limited to the specific methods and instrumentalities disclosed. In the drawings.

DETAILED DESCRIPTION OF THE INVENTION

Figure 1:
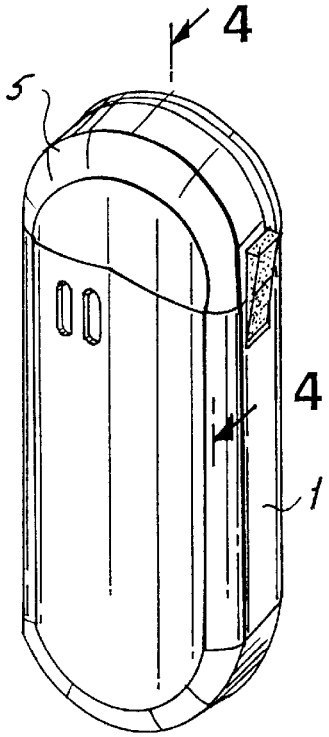
FIGS. 1 and 2 are perspective views of a piezoelectric cigarette lighter according to the present invention, respectively, in open and closed positions.

An embodiment of the present invention is illustrated in the drawings which are referred to herein. The same reference numeral will be used to identify identical elements throughout the drawings.

FIGS. 1–6 show embodiments of a piezoelectric cigarette lighter of the invention that has a lighter casing 1, within which there is a flammable liquid container 2, a piezoelectric ignition element 4, and a gas release mechanism 3 which communicates with the flammable liquid container 2 for controlling the flow of gas.

The piezoelectric ignition element 4 is used in the known manner to generate piezoelectricity when it is deformed. The piezoelectric ignition element 4 includes a movable operating part 8 which extends upwardly towards a depressing knuckle 11 at the bottom end of a striking lever 10. The piezoelectric ignition element 4 communicates with the gas release mechanism 3 by a lever 9 in such a manner that when the movable operating part 8 of the piezoelectric ignition element 4 is depressed, sparks are locally generated to ignite the gas emitted from the gas release mechanism 3.

Figure 6:
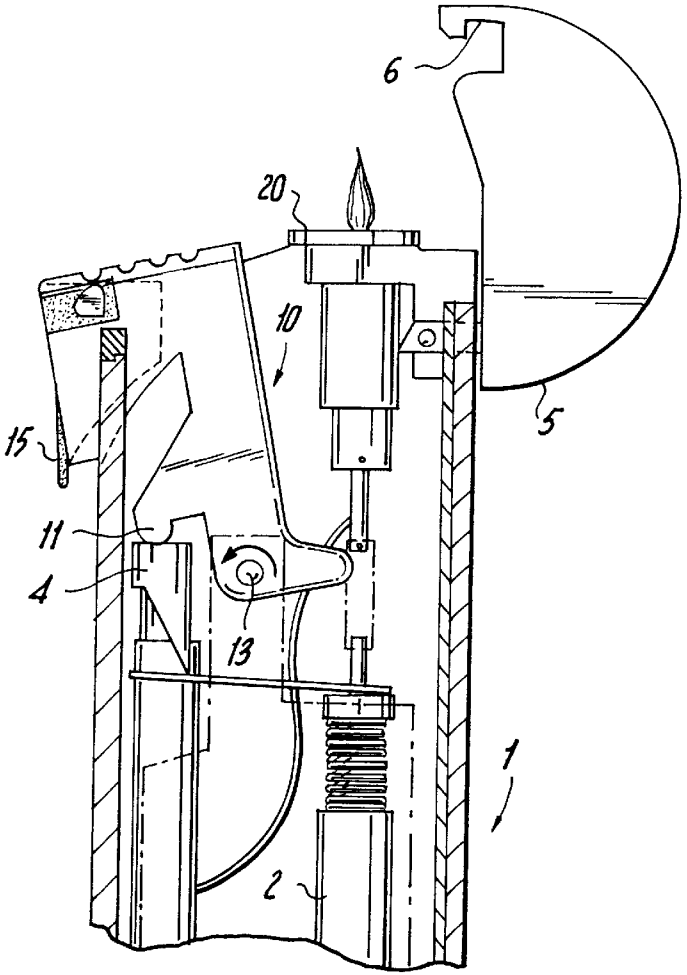
FIGS. 4, 5 and 6 are elevational cross-section views of the ignition cover, striking lever, release button and lighter body as seen substantially in the plane of line 4—4 in FIG. 1, with FIG. 5 showing one type of release button configuration, and FIGS. 4 and 6 showing a second type.
Figure 5:
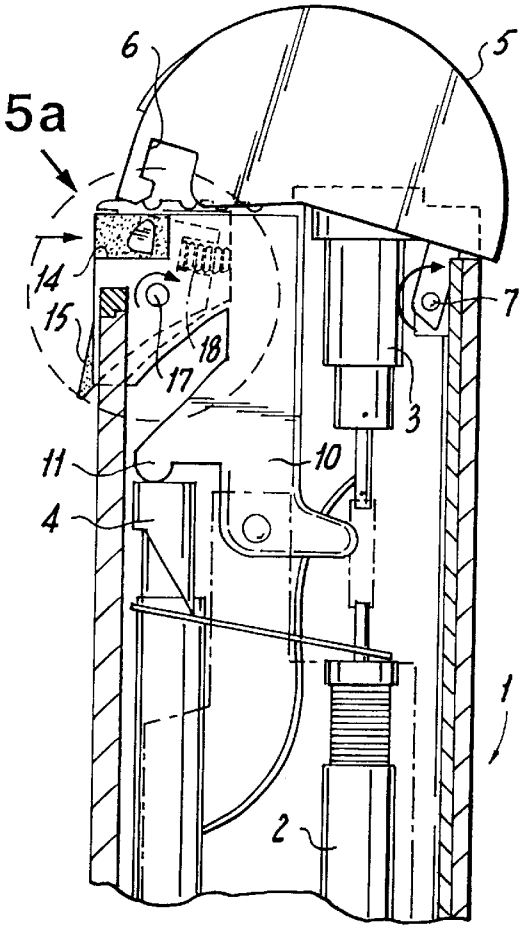
Figure 4:
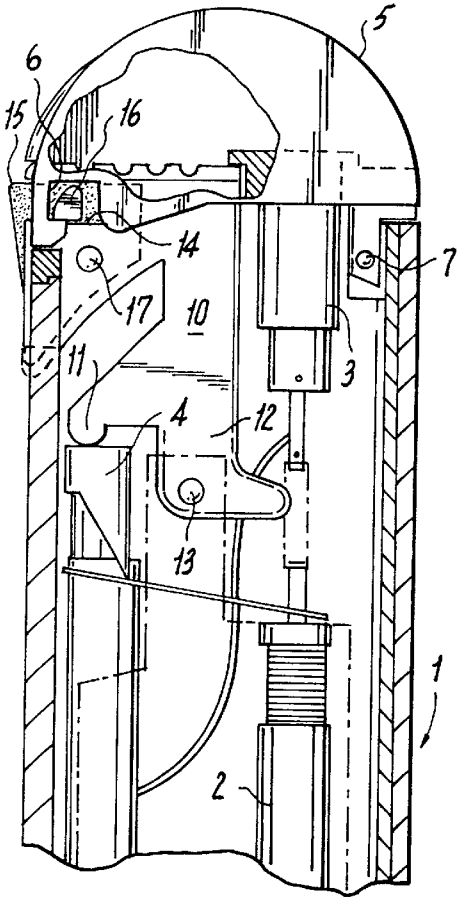
Figure 8A:
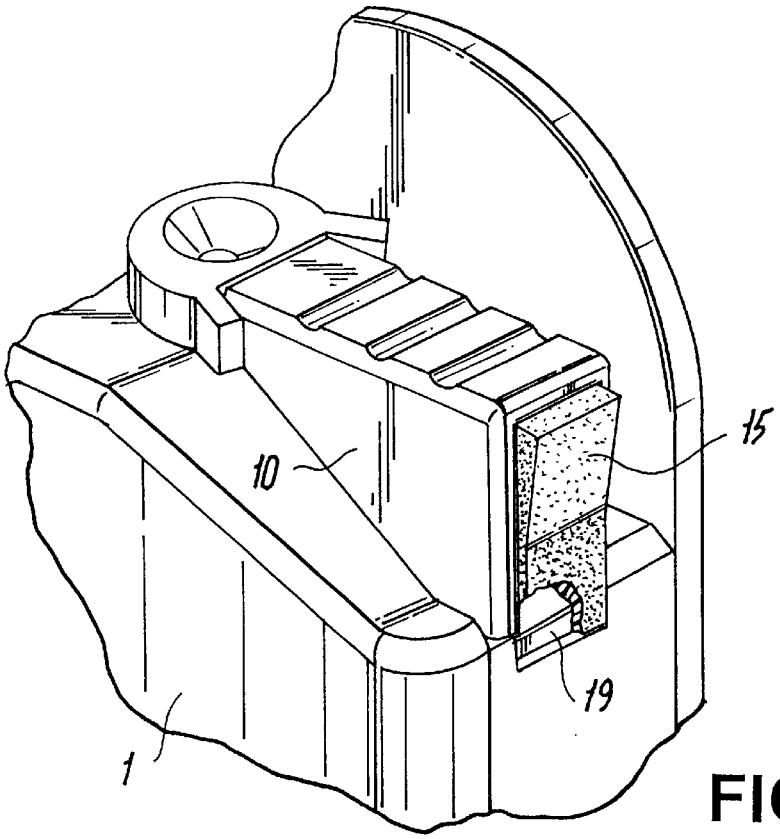
FIGS. 8A, 8B, 8C are partial perspective views of the striking lever, release button and lighter casing.

As seen in FIGS. 4–6, when the striking lever 10, is depressed (see FIG. 6), it rotates about an axle 13 which is mounted on the striking lever support 22. The striking lever 10 has a striking arm 12 whose lower end has a depressing knuckle 11. The depressing knuckle 11 rests on top of the movable operating part 8 of the piezoelectric ignition element 4. When the striking lever 10 is depressed it rotates about the axle 13 and the depressing knuckle 11 compresses the movable operating part 8 of the piezoelectric ignition element 4 which results in the generation of sparks and causes the gas emitted from the gas release mechanism 3 to ignite, and a flame appears as seen in FIG. 8*a*.

The present invention includes a two-stage safety arrangement for the lighter that is formed by an ignition cover 5, the striking lever 10, and a release button 15.

The ignition cover 5 is hollow and has opposing side walls. The ignition cover 5 also has one end pivotally attached to the lighter casing 1 at an axle 7. When closed, the ignition cover 5 conceals the upper end of the gas release mechanism 3. One of the side walls of the ignition cover 5 has a release post receiving slot 6 and a finger-type latch 6*a* for "locking" and "unlocking" the ignition cover 5 by engaging a cover release post 16 on a wall of the release button 15.

The striking lever 10 has an elongated guiding slot 14, to permit the cover release post 16 of the release button 15 to move therein. The release button 15 is rotatably mounted within the open front end of the striking lever 10 and pivots about an axle 17 also mounted in striking lever 10. When the top portion of the release button 15 is depressed, the cover release post 16 moves in the release post receiving slot 6 in the ignition cover 5.

As seen, for example in FIG. 6, the release post receiving slot 6 is of generally rectangular shape and has an inwardly extending latch finger 6*a*. When the ignition cover 5 is closed, the flat bottom wall of the cover release post 16 rests on the flat portion of the latch finger 6*a* to hold the ignition cover 5 closed. The curved bottom portion of the latch finger 6*a* rides over the curved side of the cover release post 16 to permit the ignition cover 5 to be closed when it rotates downwards.

In FIG. 5, the top portion of the release button 15 is shown depressed in a direction inwards of the lighter casing 1. This allows the cover release post 16 to clear the latch finger 6*a*, and permits the ignition cover 5 to be flipped to an "open" position with an upward pressure of a user's thumb. This is the first stage of the safety arrangement.

Figure 5B:
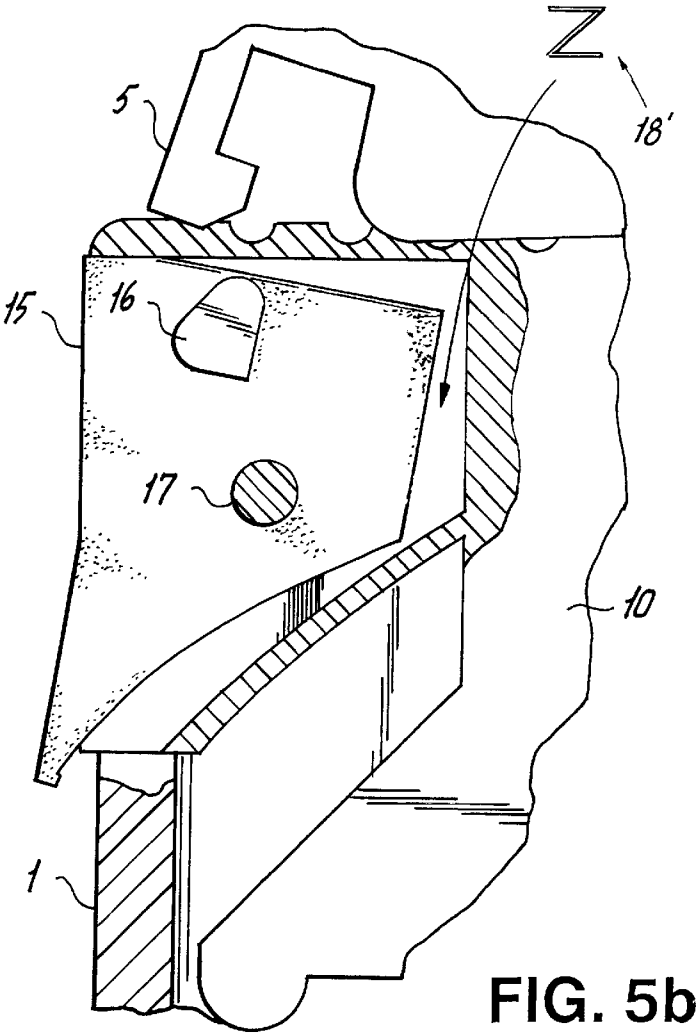
FIG 5*b* is a local cross-sectional view showing another embodiment of the resilient element.
Figure 5A:
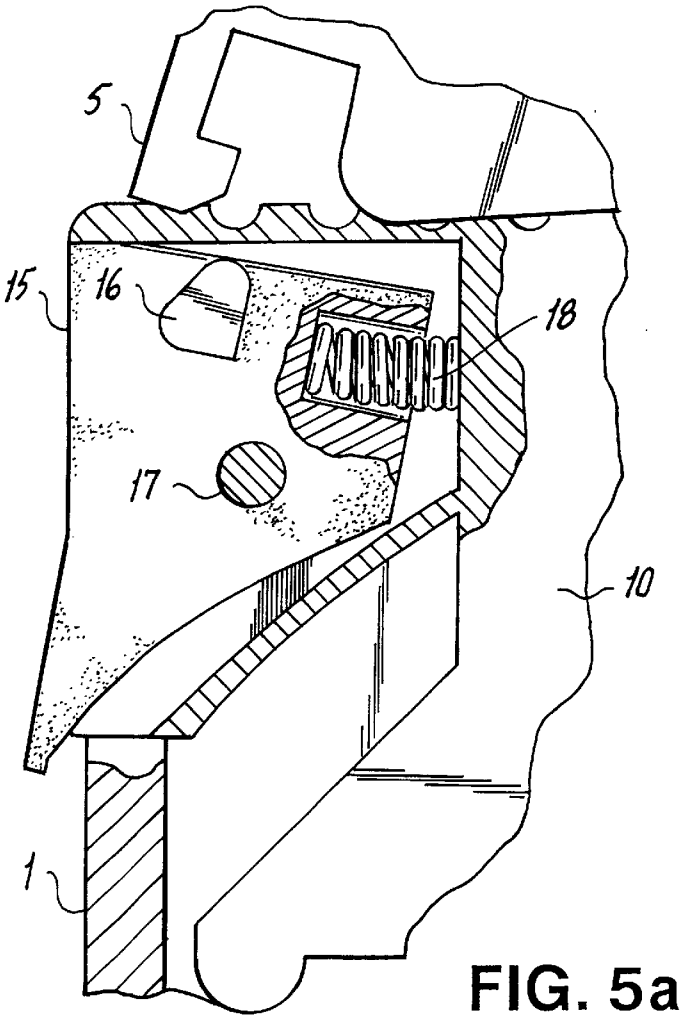
FIG. 5*a* is a local cross-sectional view showing an embodiment of the resilient element.
Figure 7:
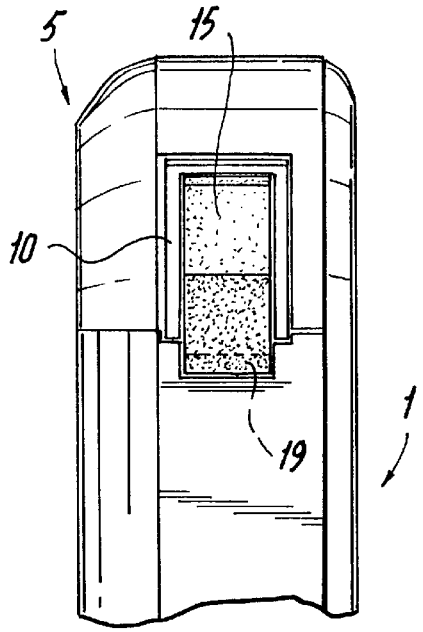
FIG. 7 is a local side view of the ignition cover, striking lever and release button.

Moreover, as seen, for example, in FIGS. 5 and 5*a* a resilient element 18, illustratively shows as a spring, is located between the release button 15 and the striking lever 10. Alternatively, FIG. 5*b* illustrates a Z-shaped spring clip 18' that can be used instead of a spring. The resilient element 18 provides an urging pressure against the release button 15, so as to bias and normally retain the cover release post 16 in the "locked" position.

Figure 8B:
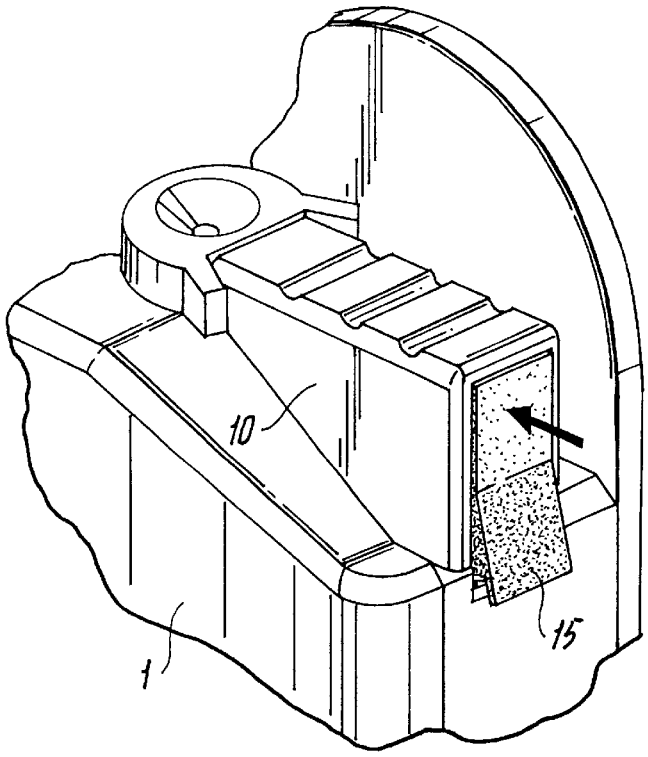
Figure 8C:
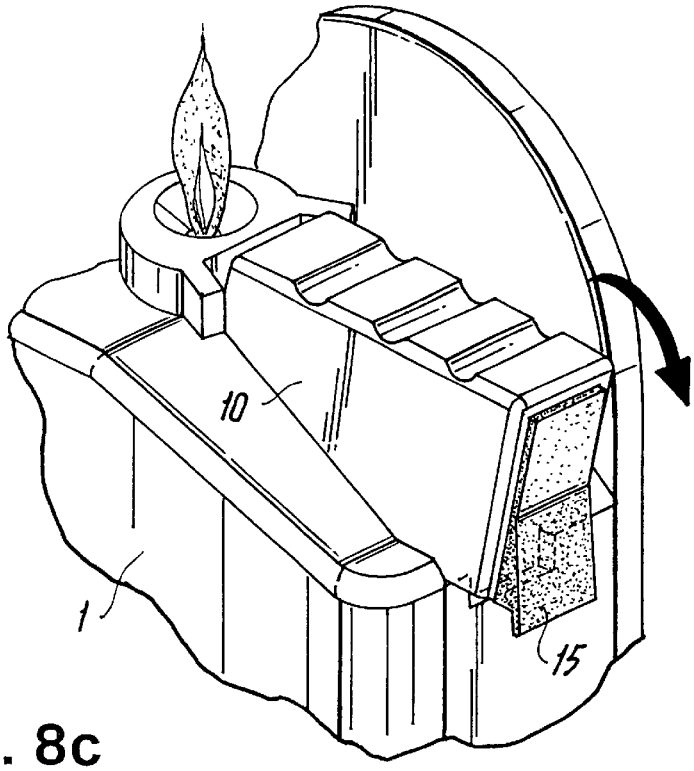

As shown in FIG. 8A, in the ignition cover's 5 "locked" position, the tail portion 21 of the release button 15 sits in, and directly engages the wall of a recessed depression 19 in the lighter casing 1. As shown in FIG. 8B, in the ignition cover's 5 "unlocked" position the tail portion 21 of the release button 15 is disengaged and does not contact the wall of the recessed depression 19 in the lighter casing 1. When the ignition cover 5 is in the "locked" position, as in FIG. 8A, the striking lever 10 cannot pivot about the axle 13 because the tail portion 21 of the release button 15 prevents rotation of the striking lever 10 by its engagement with the wall of the recessed depression 19 in the lighter casing 1. As shown in FIG. 8C, when the top portion of the release button 15 is depressed (in the direction of the arrow in FIG. 8B), the tail portion 21 of the release button 15 is lifted away from the wall of the recessed depression 19 in the casing 1. The striking lever 10 is then free to pivot about the axle 13 since there is enough clearance between the tail portion 21 of the release button 15 and the lighter casing 1. The user continues depressing the upper portion of the release button 15 as the striking lever 10 is rotated to its downward position, as shown in FIG. 6. This activates the piezoelectric ignition element 4 and the gas release mechanism 3 is opened so that the flame is produced. This is the second stage of the safety arrangement.

Figure 2:
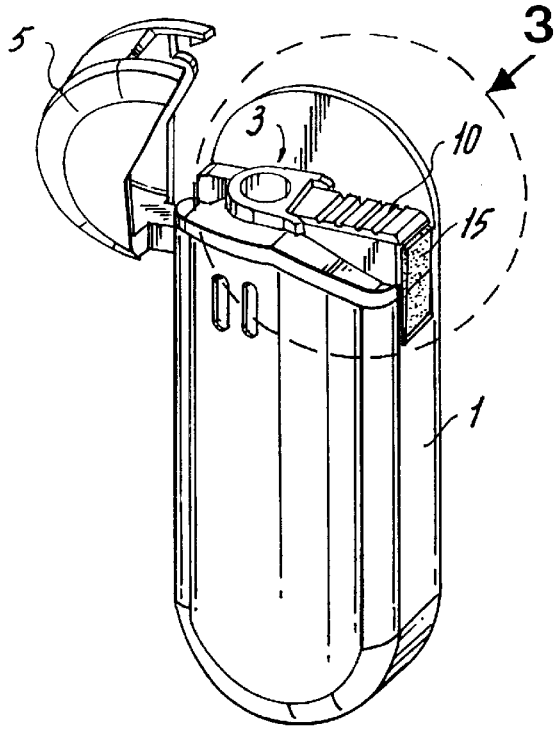
Figure 3:
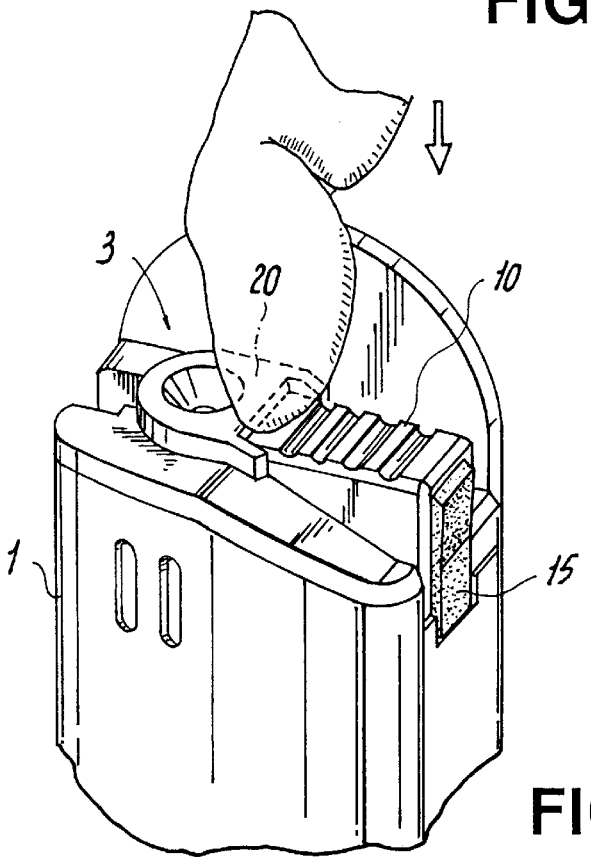
FIG. 3 is a local perspective view of the ignition cover, striking lever and release button.

As shown in FIGS. 2, 3 and 6, a raised safety ridge 20 surrounds the upper portion of the gas release mechanism 3. When the ignition cover 5 is opened, this prevents an individual from prying back the striking lever 10 from the portion of the striking lever 10 nearest to the gas release mechanism 3, and potentially burning his or her hand once a flame has been ignited.

Figure 9:
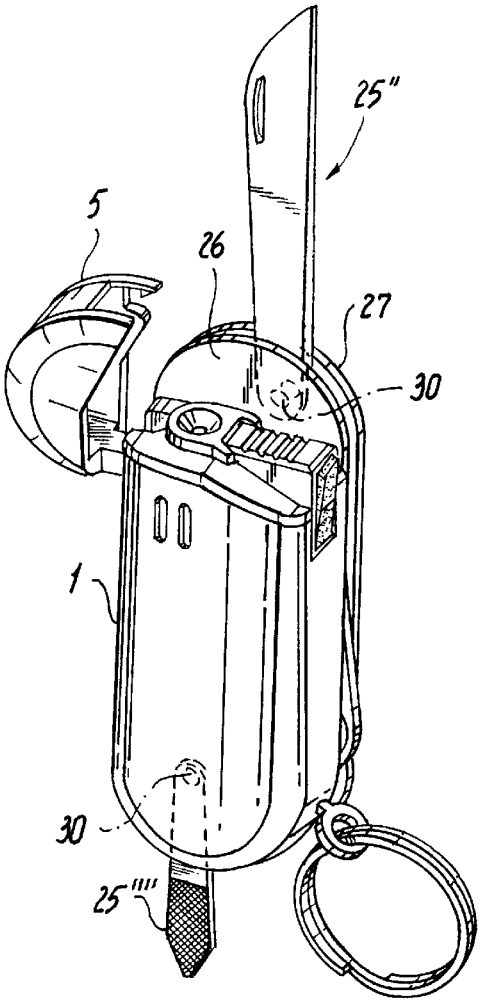
FIGS. 9, 10 and 11 are perspective cross-section views, and a side view, of two further embodiments of the piezoelectric cigarette lighter of the present invention with attached tools.
Figure 11:
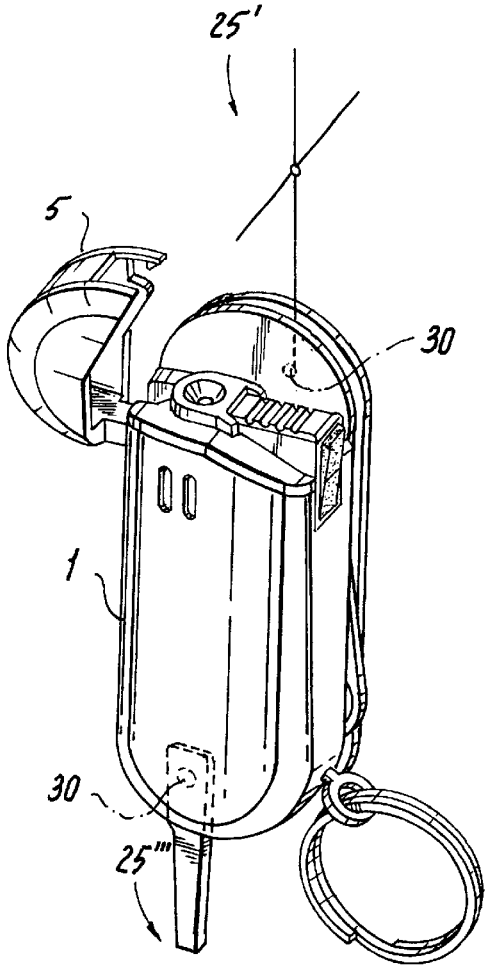
Figure 10:
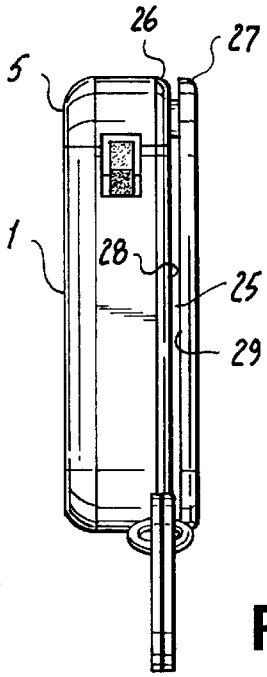

Referring to FIGS. 9, 10 and 11, tools 25 such as a scissors 25', knife blade 25", screwdriver 25'", or nail file 25"" may be pivotaly disposed between two lateral plates 26, 27 which create a narrow cavity formed, in part, by the exterior of the lighter casing 1 acting as one of the two plates 26. The two inner faces 28, 29 of the lateral plates 26, 27 are substantially flat and parallel. Rivets 30 may be used to pivotably connect the tools 25 to the inner faces 25, 29 of the two lateral plates 26, 27.

The two-stage safety arrangement for the piezoelectric cigarette lighter of the present invention prevents a lighter from being unintentionally ignited by adults and prevents activation by children. The release button 15 prevents the striking lever 10 from moving rotatably outwards, and it acts to prevent a user's unintentional exposure to the gas release mechanism 3, by only allowing the user to flip the ignition cover 5 when the lighter is to be intentionally ignited. Furthermore, children, as well as adults are prevented from igniting the lighter since they do not have the manual dexterity or power to depress the release button 15 and release the ignition cover 5, and then, in one continuous motion, simultaneously depress the release button 15 and rotate the striking lever 10 downwardly and outwardly. Additionally, the raised safety ridge 20 is utilized around the upper portion of the gas release mechanism 3 to prevent an individual without the proper amount of manual dexterity from rotating the striking lever 10 outwardly and downwardly from the portion of the striking lever 10 nearest to the gas release mechanism 3, and potentially burning his or her hand.

Specific features of the invention are shown in one or more of the drawings for convenience only, as each feature may be combined with other features in accordance with the invention. Alternative embodiments will be recognized by those skilled in the art and are intended to be included within the scope of the claims.

What is claimed is:

1. A piezoelectric lighter, comprising:

a case housing a flammable fluid container, a release mechanism for controlling the flow of fluid from said container, and a piezoelectric ignition element to produce a spark when deformed, a cover having one end pivotally mounted to said case and having a latching slot in a wall at an opposite end of said cover, a striking lever pivotally mounted to said case and having a part to engage and deform said piezoelectric ignition element and to actuate said release mechanism, and a release button pivotally mounted to said striking lever and having a latch post to move in said cover latching slot and a tail to engage said case, said release button movable by depressing said button inwardly of said case between a first position in which said latch post is in said cover latching slot to engage and lock said cover to said case and a second position in which said latch post is moved from engagement with said cover to permit said cover to be pivoted and opened, continued depression of said release button holding said tail from said case to permit said striking lever to be pivoted downwardly to engage said piezoelectric ignition element and actuate said gas release mechanism.

2. The piezoelectric lighter, as recited in claim 1, wherein said cover latching slot is formed with a finger which is engaged by said latching post when said release button is in said first position.

3. The piezoelectric lighter, as recited in claim 1, wherein the release button is biased against pivoting by a resilient element.

4. The piezoelectric lighter, as recited in claim 3, wherein said resilient element is selected from the group consisting of a compressive spring and Z-shaped spring clip.

5. The piezoelectric lighter, as recited in claim 1, further comprising a raised safety ridge positioned about said release mechanism to prevent prying back of said striking lever from a portion of said striking lever nearest to said release mechanism.

6. The piezoelectric lighter, as recited in claim 1, further comprising at least one tool rotatably coupled to said case housing.

7. The piezoelectric lighter, as recited in claim 6, wherein said at least one tool is selected from the group consisting of a scissors, knife blade, screwdriver and nail file.

* * * * *